United States Patent [19]

Wijsman

[11] 4,440,371

[45] Apr. 3, 1984

[54] POT HANGER

[75] Inventor: Dirk W. Wijsman, Rosmalen, Netherlands

[73] Assignee: Elho International B.V., Rosmalen, Netherlands

[21] Appl. No.: 278,098

[22] Filed: Jun. 29, 1981

[30] Foreign Application Priority Data

Aug. 28, 1980 [NL] Netherlands ..... 8004871

[51] Int. Cl.[3] ..... A47H 1/10

[52] U.S. Cl. ..... 248/318; 47/67; 248/316 D

[58] Field of Search ..... 248/318, 317, 339, 322, 248/316 D, 489, 497; 24/343, 346, 243 K, 255, 257 R, 137 R; 47/67

[56] References Cited

U.S. PATENT DOCUMENTS

| | | | |
|---|---|---|---|
| 2,797,886 | 7/1957 | Pinckney | 248/206 R |
| 3,184,203 | 5/1965 | Steen | 248/318 |
| 3,417,535 | 12/1968 | Zuckerman | 248/322 |
| 3,524,226 | 8/1970 | Brown | 24/346 |
| 3,600,764 | 8/1971 | Froeblich | 24/137 R |
| 3,671,004 | 6/1972 | Cram | 248/316 D |
| 3,691,596 | 9/1972 | Ulansey | 24/343 |

FOREIGN PATENT DOCUMENTS 8001985 4/1980 Netherlands .

*Primary Examiner*—Ramon S. Britts
*Assistant Examiner*—Ramon O. Ramirez
*Attorney, Agent, or Firm*—Diller, Ramik & Wight

[57] ABSTRACT

A hanger (1) for a pot (2) having a protruding rim part (3), for example, a flower pot, said hanger (1) comprising a suspension member (4) and at least three carrying members (6) connected by means of wire elements (5) with said suspension member (4), each carrying member (6) having a leg (8) bounding a slot (9) in a downward direction for resiliently engaging the rim part (3) of the pot (2), each carrying member (6) comprising at least one tongue (7, 21) connected by its lower end (10) with a leg (8) and sloping upwardly in the slot (9). The free end of the tongue preferably has a tip (11) forming in the direction upwards and transversely thereof in the direction towards the leg (8) not connected with the tongue (7, 21), the furthest protruding part of the tongue (7, 21).

3 Claims, 5 Drawing Figures

POT HANGER

The invention relates to a hanger for a pot having a protruding rim part, for example, a flower pot, said hanger comprising a suspension member and at least three carrying members connected by means of wire elements with said suspension member, each carrying member having a leg bounding a slot in downward direction for resiliently engaging the rim part of the pot.

Such a hanger is described in the Dutch Patent application No. 80.01985 and is largely employed inter alia in nursery gardens for suspending pots with plants in order to ensure maximum use of the available space. Various brands of these pots are commercially available. Each brand has its own rim design for the engagement of the hanger. Therefore, each brand of pots requires its own type of hanger. Since the various kinds of hangers can sometimes be distinguished only with difficulty, problems arise in practise in finding the correct combinations. Moreover, it is inconvenient for suppliers to have many different types of hangers on stock.

The invention has for its object to eliminate said problems. This is achieved by a hanger of the kind set forth in which each carrying member is characterized by at least one tongue connected by its lower end with a leg and sloping upwardly in the slot.

Said hanger according to the invention fits to a large number of pots having individually different rim parts. The tongue operating like a barbed hook always ensures a satisfactory fixation. Consequently, it is no longer necessary to find or to keep on stock the hanger matching each kind of the pot.

When, in accordance with the invention, the free end of the tongue has a tip forming in the direction upwards and transversely thereof in the direction towards the leg not connected with the tongue, the furthest protruding part of the tongue, it is ensured that the tongue finds a firm grip even beneath the smallest rim.

Further features and advantages of the invention will become apparent from the following description of embodiments of the invention with reference to the drawings.

Figure 1:
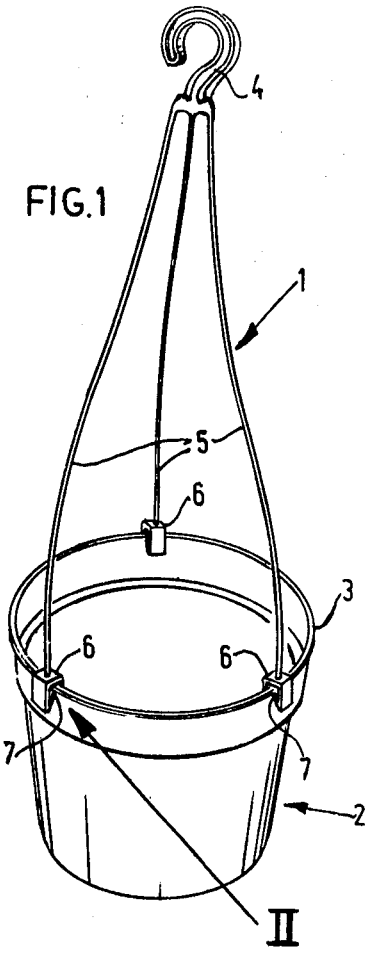
FIG. 1 is a perspective view of a pot with a hanger embodying the invention.

The hanger 1 comprises a suspension member 4 and three carrying members 6, which are connected by means of wire elements 5 with the suspension member 4. The carrying members 6 engage a rim part 3 of a pot 2.

Figure 2:
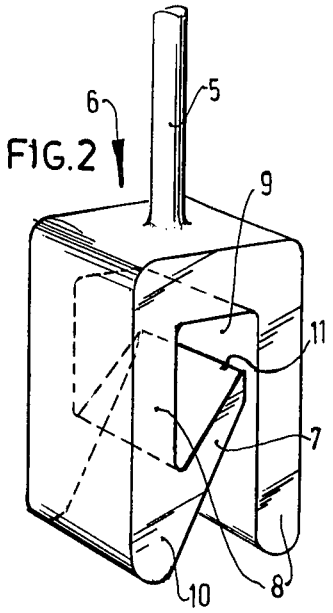
FIG. 2 shows a detail II of FIG. 1.
Figure 3:
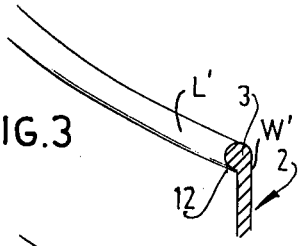
FIG. 3 shows a rim part of the pot.
Figure 4:
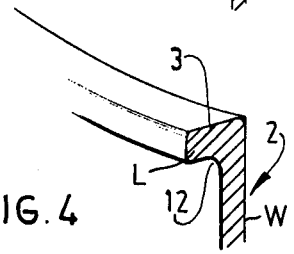
FIG. 4 shows a part of a different shape.

The carrying member 6, by which the hanger 1 engages the pot 2, is shown more clearly in FIG. 2. This carrying member has two legs 8 bounding a slot 9 for accomodating the rim part 3 of the pot 2. The rim part 3 is defined by the circumscribing top wall portion W terminating in an enlarged lip L overhanging the top wall portion to define a corner 12 as shown in FIG. 4. In FIG. 3, the top wall portion is designated W' and the lip L'. According to the invention the carrying member has a tongue 7 connected by its lower end 10 with a leg 8 and extending upwards in the slot 9. Owing to this tongue 7 operating like a barbed hook it is possible to grip around rim parts 3 of dimensions varying within wide limits.

FIGS. 3 and 4 show two possible rim parts which the carrying member 6 according to the invention can engage without any problem. Between the rim part 3 and the remaining part of the pot 2 a corner 12 is formed, in which the tongue 7 can engage.

According to the invention the free end of the tongue preferably has a tip 11 forming in the direction upwards and transversely thereof in the direction towards the leg 8 not connected with the tongue 7, the furthest protruding part of the tongue. It is thus ensured that the tip 11 will always grip in a corner 12 of the pot 2. The heavier becomes the weight hanging on the carrying member, the higher will be the clamping force of the tongue 7 on the rim part 3, since the tongue 7 is urged by the vertical force towards the opposite leg 8. This is aided by virtue of the fact that the tongue is not only thinner than the legs 8 but also tapers toward the tip 11, and that the tip 11 is itself tapered to be of chisel-like form, as shown.

In order to permit of putting the carrying member 6 into engagement with the rim part 3 of the pot 2, the tongue 7 must be capable of deflecting resiliently with respect to the opposite leg 8. In the embodiment shown, in which the entire carrying member is an integral unit, the material of the carrying member 6 must, therefore, have resilient properties. According to the invention the whole hanger is preferably made from a synthetic resin having suitable resilient properties. Polypropene, for example, is a suitable synthetic resin for this purpose.

Figure 5:
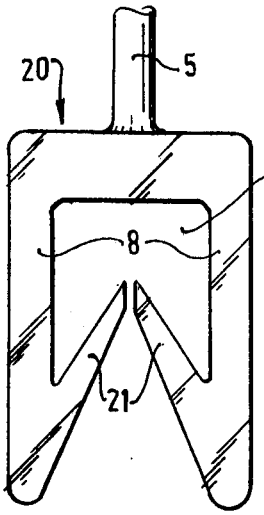
FIG. 5 is a side elevation of an alternative embodiment of a carrying member on a scale corresponding with that of FIG. 2.

FIG. 5 shows alternative embodiment in which the carrying member 20 has two tongues 21. The operation of these tongues 21 corresponds with that of the tongue 7 in the former embodiment.

What is claim is:

1. A hanger assembly for use with pots of the type having a circular rim defined by a circumscribing top wall portion terminating in an enlarged lip overhanging said top wall portion, said assembly comprising a hanger portion having at least three flexible rod-like members depending therefrom and each having a carrying member connected thereto, each carrying member being of inverted generally U-shape to define a pair of spaced legs joined at their upper ends by a bridge piece and each leg being of greater length than of width so each pair of spaced legs is able to accomodate the circular rim therebetween with clearance, the opposed surfaces of said legs near said bridge piece being spaced apart by an amount greater than the thickness of said rim whereby to straddle such rim with said clearance, a tapered tongue angling upwardly from the lower end of one of said legs generally toward the juncture of the other leg and said bridge piece, said tongue terminating in a tip which is in spaced relation to such juncture and in spaced relation to said other leg such that said tip engages against said top wall portion in underlying relation to said lip and supports the pot by downward pressure of said lip on said tongue, said tongue being of a thickness less than that of said one leg and tapering toward said tip, each said carrying member being formed of resilient material whereby the weight of said pot preferentially deforms said tongue and especially the tip thereof to increase the pressure thereof against said top wall portion below said lip.

2. A hanger assembly as defined in claim 1 wherein the tip of said tongue is formed as a chisel-like edge to bear against the undersurface of said lip substantially at its juncture with said top wall portion.

3. A hanger assembly as defined in claim 1 in combination with a pot having a circular rim defined by a circumscribing top wall portion terminating in an enlarged lip overhanging said top wall portion.

* * * * *